United States Patent [19]

Cain

[11] Patent Number: 4,991,297

[45] Date of Patent: Feb. 12, 1991

[54] SAFETY GUARD FOR CHAIN SAW BAR

[76] Inventor: Myron C. Cain, 6254 Coast Hwy., North Bend, Oreg. 97459

[21] Appl. No.: 408,740

[22] Filed: Sep. 18, 1989

[51] Int. Cl.[5] ..... B27B 17/02
[52] U.S. Cl. ..... 30/382
[58] Field of Search ..... 30/381–387

[56] References Cited

U.S. PATENT DOCUMENTS

| | | | |
|---|---|---|---|
| 2,937,673 | 5/1960 | Duperron et al. . | |
| 3,059,673 | 10/1962 | Woleslagle . | |
| 3,384,136 | 5/1968 | Marin . | |
| 3,754,328 | 8/1973 | Knerr | 30/382 |
| 4,060,894 | 12/1977 | Hampton | 30/382 |
| 4,193,193 | 3/1980 | Holzworth | 30/382 |
| 4,621,426 | 11/1986 | Shivers | 30/382 |

FOREIGN PATENT DOCUMENTS

| | | | |
|---|---|---|---|
| 746304 | 11/1966 | Canada | 30/382 |

*Primary Examiner*—Douglas D. Watts
*Attorney, Agent, or Firm*—Kolisch, Hartwell, Dickinson, McCormack & Heuser

[57] ABSTRACT

A chain saw guard is intended for use on a chain saw, which includes a motor housing, a drive motor contained in the housing, a saw chain guide bar mounted on the motor housing and a saw chain driven by the drive motor and carried on the guide bar. The guard includes a saw chain guard plate which extends from the housing forward over the guide bar. A bracket is provided for rotational mounting of the guard plate on the motor housing. The bracket is mounted on the housing on the same mounting as the chain guide bar. A limiting mechanism is provided on the bracket for providing limited rotational movement of the guard plate relative to the bracket.

16 Claims, 2 Drawing Sheets

SAFETY GUARD FOR CHAIN SAW BAR

BACKGROUND OF THE INVENTION

The instant invention relates to a guard for a chain saw, and specifically to a guard which will prevent serious injury to a chain saw user in the event that the saw "kicks back".

A number of devices are known which either surround or cover the guide bar on a chain saw to prevent contact between the saw chain and the user in the event of chain saw kickback. In order for the saw to continue to have full utility, such guards must allow the saw to pass through the material which is intended to be cut while providing minimal interference with the cutting operation. To this end, a variety of springs, levers and guard configurations have been proposed. While the devices may be useful, they do tend to limit the utility of the chain saw because of the complexity of the mounting mechanism and the guard devices.

An object of the invention to provide a chain saw guard which allows full use of the saw for both over-cutting and under-cutting operations.

Another object of the invention is to provide a chain saw guard which will raise above a predetermined level to allow passage of the saw chain through the material which is being cut, and which will return to its normal position at the end of the cutting operation.

A further object of the invention is to provide a chain saw guard which may be adjusted to a predetermined height above the chain saw guide bar.

Still another object of the invention is to provide a chain saw guard which incorporates a mechanism for holding the guard away from the saw chain and guide bar during certain operations, such as when the saw chain is being sharpened, while the guard is installed on the chain saw.

Another object of the invention is to provide a chain saw guard which is easy to use, economical to manufacture and which has a minimal number of components, to insure that the guard will be used as intended once installed on a chain saw.

SUMMARY OF THE INVENTION

The chain saw guard of the invention is intended for use on a chain saw, which includes a motor housing, a drive motor contained in the housing, a saw chain guide bar mounted on the motor housing and a saw chain driven by the drive motor and carried on the guide bar. The guard of the invention includes a saw chain guard plate which extends from the housing forward over the guide bar. A bracket is provided for rotational mounting of the guard plate on the motor housing. The bracket is mounted on the housing on the same mounting as the chain guide bar. A limiting mechanism is provided on the bracket for providing limited rotational movement of the guard plate relative to the bracket.

These and other objects and advantage of the invention will become more fully apparent as the description which follows is read in conjunction with the drawings.

DETAILED DESCRIPTION OF THE PREFERRED EMBODIMENT

Figures 1, 4:
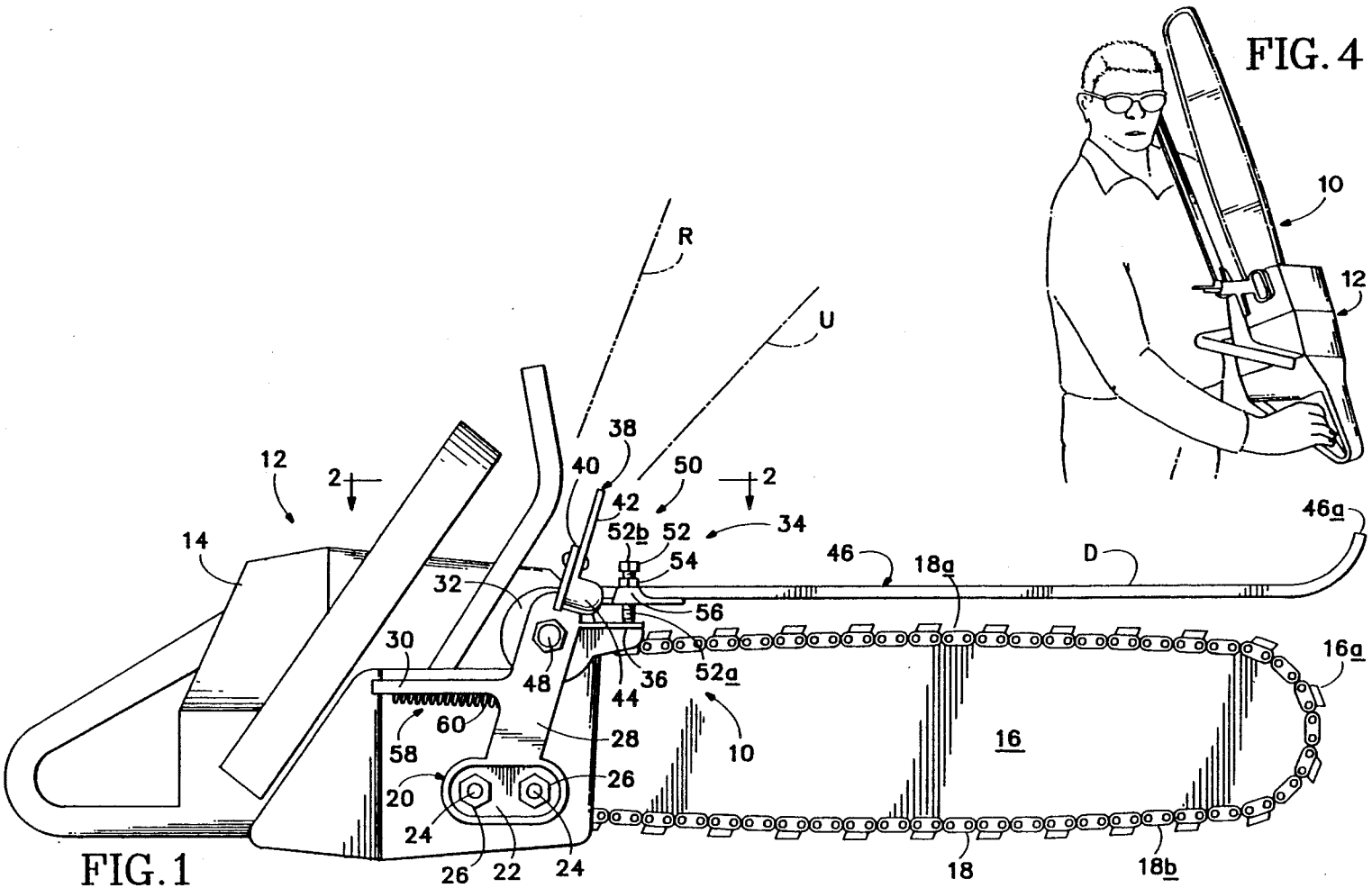
FIG. 1 is a side elevation of a chain saw having the chain saw guard of the invention carried thereon.
FIG. 4 is a perspective, environmental view depicting the manner in which the chain saw guard of the invention prevents serious injury to a user in the event of chain saw kickback.

Turning now to the drawings, initially to FIG. 1, a chain saw guard constructed according to the invention is shown generally at 10. Guard 10 is mounted on a chain saw 12. Saw 12 is conventional in design and includes a motor housing 14, containing a drive motor therein (not shown), a saw chain guide bar 16 which is mounted on motor housing 14, and a saw chain 18 which is carried on guide bar 16 and driven by the drive motor.

Guard 10 includes a mounting bracket 20 which is mounted to housing 14 utilizing the same mounting mechanism as guide bar 16. Bracket 20 includes a receiver portion 22 having a pair of bores therein, through which threaded shafts 24 extend, which in turn receive nuts 26 thereon to retain the bracket and guide bar on the motor housing. Shafts 24 and nuts 26 are part of the guide bar mounting mechanism.

Bracket 20 is substantially vertically disposed on the chain saw and has an upwardly extending portion 28, which extends upwardly from receiver 22. A rearwardly extending portion 30 is located adjacent the upper end of portion 28 intermediate the top and bottom thereof, and extends towards the rear of motor housing 14.

A guard plate mount 32 is located at the top, free end, of upwardly extending portion 28, and may be either integrally formed with bracket 20 or secured thereto by welding.

Figure 2:
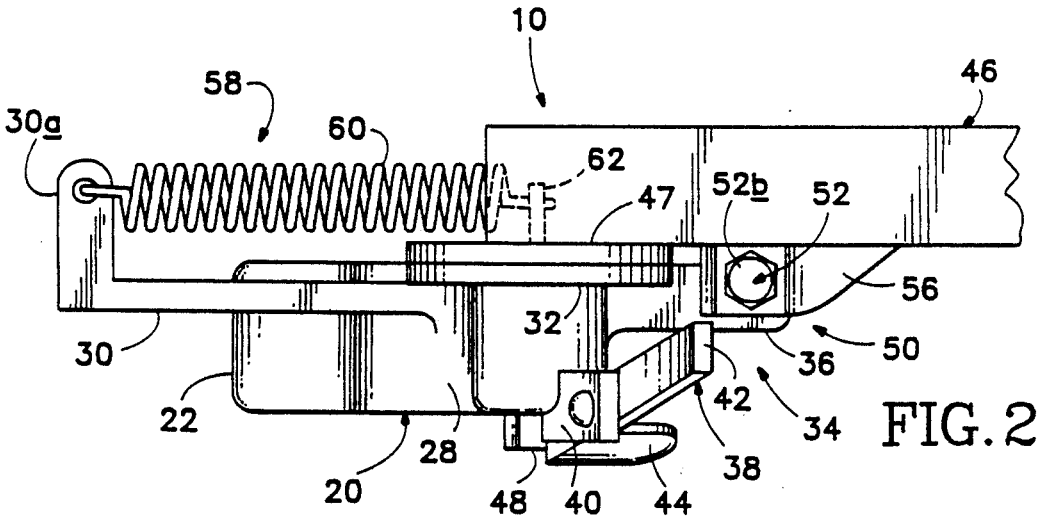
FIG. 2 is a top plan view of a portion of the chain saw guard, taken generally along the line 2—2 of FIG. 1.
Figure 3:
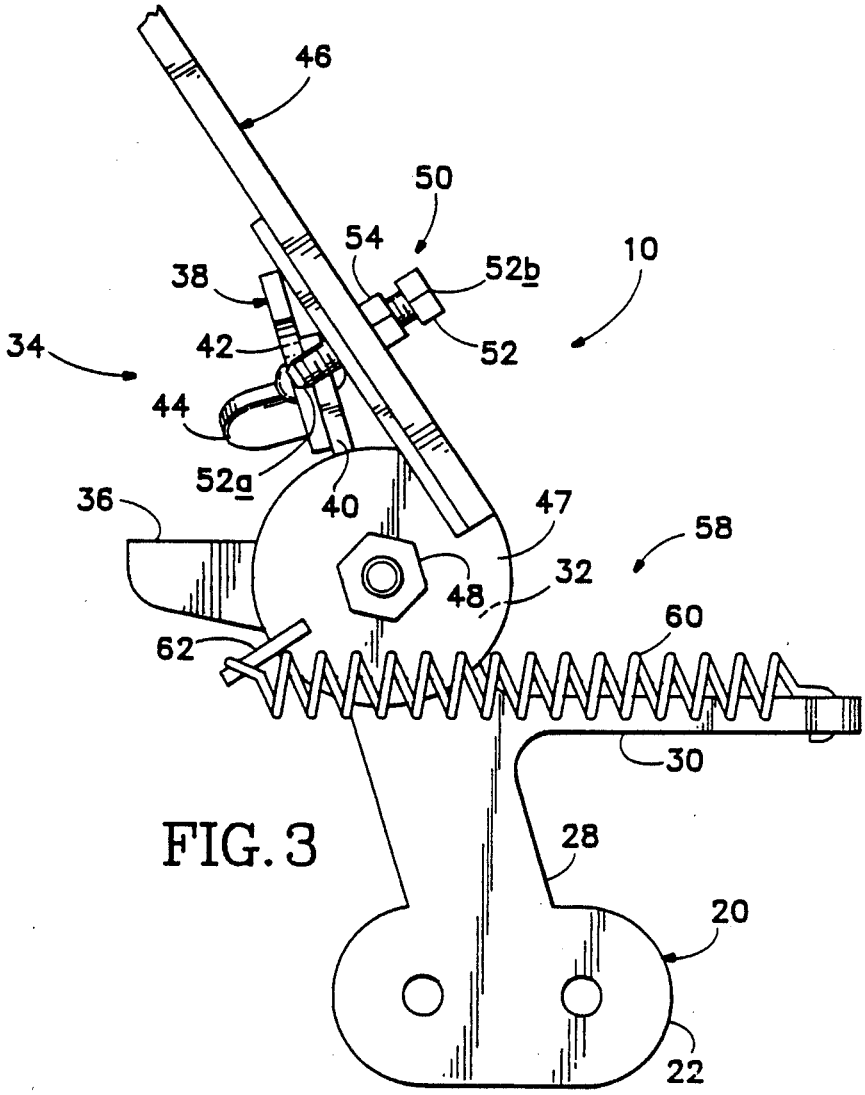
FIG. 3 is a side elevation of a portion of the chain saw guard of the invention of FIG. 1, with the guard depicted in a second range.

Referring now to FIGS. 1–3, the bracket includes what is referred to herein as limit means, shown generally at 34. Limit means includes a first stop 36 carried on the bracket, which in the preferred embodiment extends forward of the upwardly extending portion 28, and a second stop 38. In the preferred embodiment, stop 38 includes a flange 40 secured to the top of upwardly extending portion 28 and a lever 42, having a grip 44.

A saw chain guard plate 46 includes a mount portion 47 and is rotatably mounted on guard plate mount 32. Guard plate 46 is held in place by a nut and bolt combination 48. The ease with which guard plate 46 may rotate relative to bracket 20 depends upon the tightness with which mount portion 47 is fastened to guard plate mount 32 by nut and bolt 48. The tightness, and the friction between mount portion 47 and plate mount 32 must be such that the guard plate may freely swing upward and downward, yet not be so loose as to allow free movement of the guard plate under its own inertia. An alternate form of the mount may include an adjustable clutch mechanism to easily vary the tension between mount portion 47 and guard plate mount 32.

Guard plate 46 extends from bracket 20 forward of housing 14 over guide bar 16. In the preferred embodiment, a free end **46*a* of guard plate 46 is up turned and extends beyond a free end 16*a* of guide bar 16**.

Guard plate 46 includes contacting means 50 which cooperates with first stop 36 and second stop 38 to define a range of motion for the guard plate. In the preferred embodiment, contacting means includes a set screw 52 and a lock nut 54. Set screw 52 has a first end 52*a* which contacts first stop 36 and which is referred to herein as first-stop contacting means. The set screw has a second end 52*b* which contacts lever 42 when the lever is in a first position and is referred to herein as second-stop contacting means. The length of set screw 52 extending beyond a set screw mount 56 on guard plate 46 determines the height at which guard plate 46 rests above the upper surface 18*a* of saw chain 18, which is referred to as the down position of the guard plate and positions the guard plate at a predetermined height above the guide bar.

Lever 42, when positioned in its first position, is operable to limit the upward movement of the guard plate when the lever comes in contact with end 52*b* of set screw 52, thus defining a second predetermined height of the guard plate above the guide bar, which is also referred to herein as an up position, which is indicated by dash-dot line U. The position of guard plate 46 in FIG. 1, indicated by D, depicts the guard plate in its down position. When the guard plate is in the region between position D and position U, it is said to be in its first range. With the lever moved into a second position, the guard plate is free to bypass the lever, bypassing the second predetermined height, or position, and rotating into what is referred to herein as a second range, after which the lever maybe shifted to the first position again where it will retain the guard plate in a raised position, as depicted by R in FIG. 1, such as might be desirable if the saw chain is to be sharpened.

Spring biasing means is depicted generally at 58 and includes a spring 60 which is secured to a tab 30*a* on rearwardly extending portion 30 and to a flange 64, which is located on a mount portion 47 of guard plate 46. Spring biasing means 58 is operable to bias the guard plate to the down position, thereby bringing the guard plate in contact with first-stop 36.

In operation, the chain saw is positioned to begin cutting with the lower saw chain surface 18*b*. As the saw chain and guide bar pass through a workpiece (i.e. the object being cut), the lower surface of guard plate 46 contacts the workpiece and is shifted upward relative to the guide bar as the guide bar passes through the workpiece. At the end of the cut, spring biasing means 58 pulls the guard plate to its down position such that end 52*a* of set screw 52 contacts first-stop 36.

In those circumstances where the user desires to undercut a workpiece, the free end 16*a* of guide bar of 16 is positioned close to the work piece and the upturned end 46*a* of guard plate 46 is placed in contact with the workpiece. The guide bar may then be positioned under the workpiece simultaneously with the workpiece being used to maneuver guard plate 46 to its up position. Depending upon the initial positioning of lever 42, it may be necessary to move lever 42 such that it will not contact the upper end 52*a* of set screw 52, thereby retarding the movement of guard plate 46.

In order to perform maintenance on saw chain 18, such as sharpening, guard plate 46 may be moved to its raised position, R, which is located in the guard plate's second range of motion, by shifting lever 42 to its open position and rotating guard plate 46 to its second range beyond the second predetermined rotational position. Lever 42 may then be moved to its first position allowing the bottom 52*a* of set screw 52 to contact the upper, rearward facing side of lever 42, thereby holding the guard plate in a fully raised position. With the guard plate in such a position, work on saw chain 18 may occur without interference from guard plate 46.

In the event that, in the course of its use on a workpiece, saw 12 kicks back, guard plate 46 will prevent contact between the saw chain and the user. Such a situation is depicted in FIG. 4 wherein the chain saw, as a result of hitting a foreign object in a work piece, has kicked back striking the user with the guard plate. Such a condition, while resulting in a certain amount of pain to the user, is much preferable to the situation where a moving saw chain contacts the user in what has, in the past, resulted in a number of fatalities. Guard plate 46 has a certain springy characteristic thereto and, as guard plate 46 contacts the user, will tend to bounce the chain saw away from the user.

In the event that the user is making an under cut with the chain saw, any unexpected movement of the chain saw, as may be induced by the saw chain striking a foreign object in the work piece, will result in the chain saw being forced downward and rearward. Depending on which direction carries the greatest force, the guard plate may prevent complete downward movement of the chain saw. If the chain saw is forced rearward, such that the guard plate clears the work piece, and simultaneously downward, the striking of any objects below the work piece and subsequent kickback will produce the same situation as depicted in FIG. 4 should the saw fly upward and rearward.

Thus a chain saw guard has been disclosed which is easily installed on existing chain saws and which only minimally interferes with the normal operation of the chain saw. The guard is constructed to prevent contact between the user's body and the saw chain carried on the chain saw in the event that the chain saw kicks back in the course of working on a work piece. Although a preferred embodiment of the invention has been disclosed, it should be appreciated that variations and modifications may be made thereto without departing from the scope of the invention as defined as the appended claims.

What I claim is:

1. A chain saw guard for use on a chain saw having a motor housing, a drive motor contained in the housing, a saw chain guide bar mounted on the motor housing, and a saw chain driven by the drive motor and carried on the guide bar comprising:

a saw chain guard plate which extends from the housing forward over the guide bar;

a bracket for rotationally mounting said guard plate on the motor housing between an up position and a down position, said bracket being mounted on the housing to the same mounting as the chain guide bar, wherein said bracket is substantially vertically disposed on the chain saw and has rearwardly extending portion located intermediate the top and bottom thereof, and which further includes spring-biasing means located between the free end of said rearwardly extending portion of said bracket and said guard plate to bias said guard plate to said down position; and limit means on said bracket for providing limited rotational movement of said guard plate relative to said bracket, including a first stop on said bracket for positioning said guard plate a predetermined height above said guide bar and a second stop on said bracket for limiting the upward movement of said guard plate to said up position, wherein said second stop is constructed and arranged to allow said guard to bypass said up position and with said guard in a raised position, to contact said guard plate thereby maintaining said guard plate in said raised position.

2. The guard of claim 1 wherein said limit means includes a first stop on said bracket for positioning said guard plate a predetermined height above said guide bar.

3. The guard of claim 1 wherein said limit means includes a second stop on said bracket for limiting the upward movement of said guard plate.

4. The guard of claim 3 wherein said second stop includes a lever which is shiftable between a first position for limiting upward movement of said guard plate and a second position for retaining said guard plate in a raised condition.

5. The guard of claim 1 wherein said guard plate extends beyond the free end of the guide bar.

6. The guard of claim 1 wherein said guard plate has an upturned free end.

7. A chain saw guard for use on a chain saw having a motor housing, a drive motor contained in the housing, and a saw chain guide bar mounted on the motor housing, a saw chain driven by the drive motor and carried on the guide bar comprising:

a saw chain guard plate which extends from the housing forward over the guide bar;

a bracket for rotationally mounting said guard plate on the motor housing, said bracket being mounted on said housing to the same mounting as the chain guide bar, wherein said bracket is substantially vertically disposed on the chain saw and has a rearwardly extending portion located intermediate the top and bottom thereof;

limit means on said bracket for providing limited rotational movement of said guard plate relative to said bracket, said limit means including a first stop on said bracket for positioning said guard plate a predetermined height above said guide bar and a second stop on said bracket for limiting the upward movement of said guard plate to a second predetermined height, the region between said first and second predetermined heights defining a first range; and spring-biasing means located between the free end of said rearwardly extending portion and said guard plate to bias said guard plate to a down position wherein said guard plate is in contact with said first stop.

8. The guard of claim 7 wherein said guard plate extends beyond the free end of the guide bar.

9. The guard of claim 7 wherein said guard plate has an upturned free end.

10. The guard of claim 7 wherein said guard includes second-stop contacting means thereon for contacting said second stop for limiting the upward rotational movement of said guard to a second predetermined position, and wherein said second-stop contacting means is shiftable to allow said guard to bypass said second stop thereby leaving said first range and entering a second range which is located beyond said second predetermined height.

11. The guard of claim 7 wherein said second stop includes a lever which is shiftable between a first position for limiting upward movement of said guard plate to said first range and a second position for retaining said guard plate in a raised condition in said second range.

12. A chain saw guard for use on a chain saw having a motor housing, a drive motor contained in the housing, a saw chain guide bar mounted on the motor housing, and a saw chain driven by the drive motor and carried on the guide bar comprising:

a mounting bracket mounted on said housing on the same mounting as the chain guide bar, wherein said bracket has a rearwardly extending portion located adjacent the top thereof;

a saw chain guide plate which extends from the housing forward over the guide bar, said guard including adjustable first-stop contacting means thereon for setting a down position of said guard relative to the guide bar and a second-stop contacting means for setting an up position of said guard relative to the guide bar;

limit means on said bracket for providing limited rotational movement of said guard plate relative to said bracket, said limit means including a first stop on said bracket for positioning said guard plate a predetermined height above said guide bar and a second stop said bracket for limiting the upward movement of said guard plate to a second predetermined rotational position; and spring-biasing means located between the free end of said rearwardly extending portion and said guard plate to bias said guard plate to a down position wherein said guard plate is in contact with said first stop.

13. The guard of claim 12 wherein said guard plate extends beyond the free end of the guide bar.

14. The guard of claim 12 wherein said guard plate has an upturned free end.

15. The guard of claim 12 wherein said second stop includes a lever which is shiftable between a first position, for limiting upward movement of said guard plate to said up position and a second position which allows said guard plate to rotate beyond said up position to a raised position.

16. The guard of claim 13 wherein said second stop is constructed and arranged to allow said guard to bypass said first position and with said guard in a raised position, to contact said guard plate thereby maintaining said guard plate in said raised position.

* * * * *